United States Patent [19]

Faupel et al.

[11] Patent Number: 4,635,605

[45] Date of Patent: Jan. 13, 1987

[54] FUEL INJECTION PUMP FOR INTERNAL COMBUSTION ENGINES

[75] Inventors: Werner Faupel, Gerlingen; Klaus Schmidt, Vaihingen/Enz, both of Fed. Rep. of Germany

[73] Assignee: Robert Bosch GmbH, Stuttgart, Fed. Rep. of Germany

[21] Appl. No.: 740,139

[22] Filed: Jun. 3, 1985

[30] Foreign Application Priority Data

Jul. 6, 1984 [DE] Fed. Rep. of Germany ..... 3424883

[51] Int. Cl.[4] ..... F02M 39/00

[52] U.S. Cl. ..... 123/449; 123/503; 123/506; 417/289

[58] Field of Search ..... 123/449, 503, 506, 373; 417/289, 494, 499, 485, 500

[56] References Cited

U.S. PATENT DOCUMENTS

| | | | |
|---|---|---|---|
| 3,942,914 | 3/1976 | Hofer et al. | 123/449 |
| 4,284,047 | 8/1981 | Stumpp | 417/289 |
| 4,407,253 | 10/1983 | Bauer | 123/449 |

FOREIGN PATENT DOCUMENTS

| | | | |
|---|---|---|---|
| 3203582 | 8/1983 | Fed. Rep. of Germany | 123/503 |
| 0105616 | 8/1979 | Japan | 123/503 |
| 0000545 | 1/1981 | Japan | 123/449 |
| 0082572 | 5/1984 | Japan | 123/449 |

*Primary Examiner*—Carl Stuart Miller

*Attorney, Agent, or Firm*—Edwin E. Greigg

[57] ABSTRACT

A fuel injection pump of the distributor type is proposed, in which the injection quantity is controlled by controlling the first outlet cross section D of a first relief line and the stroke-offset outlet C of a second relief line for the pump work chamber of the fuel injection pump by means of a control edge that is variable in accordance with load and/or rpm. To attain nonsupply of fuel within the intended supply stroke of the pump piston during idling and at low partial load, communication between the first and second relief lines is provided. The communication exists only for the duration of a predetermined stroke portion ($h_e$) and is additionally controlled in accordance with load and/or rpm by controlling the following outlet of the second relief line, so that from a predetermined upper load range to full-load operation, the entire fuel quantity pumped by the pump piston over the effective supply stroke does in fact become injected.

15 Claims, 8 Drawing Figures

FUEL INJECTION PUMP FOR INTERNAL COMBUSTION ENGINES

BACKGROUND OF THE INVENTION

The invention is based on a fuel injection pump of the type defined hereinafter. A fuel injection pump of this kind, known from German Offenlegungsschrift No. 23 53 737, has the object of shifting the onset of injection toward "late" as the load decreases. The control cross sections in the known fuel injection pump are embodied such that the injection onset is varied at low load by enabling a partial amount of the fuel pumped to drain out before the injection per se begins. In the most extreme case, this drainage can be effected up to a predetermined piston stroke, and within the limits of this condition the drainage is further controlled in that the instant during the pump piston stroke at which the outlet of the second relief conduit is opened is also determined by the position of a quantity adjusting device, which is embodied as an annular slide that is displaceable on the pump piston in accordance with load or rpm. The provision made in the known fuel injection pump is that in the idling range and in a portion of the partial load range, the piston stroke over the duration of which communication between the first and second relief conduits is established is fully exploited for relieving purposes. As the load increases, a limitation of this possible relief quantity is effected by means of opening the outlet of the second relief conduit later than otherwise. The effect, in this load range, is an increasingly earlier injection onset, and at full load operation or in the upper partial load range, any relief of the pump work chamber is precluded entirely, so that the pump piston can cause its entire full-load injection quantity to be injected, and no further shift of the injection onset toward "late" takes place.

OBJECT AND SUMMARY OF THE INVENTION

The fuel injection pump according to the invention and having the characteristics revealed herein has the advantage over the prior art that during idling and up to a portion of the partial load range, the fuel injection is interrupted or reduced over the course of a constant piston stroke, and a variation of the injection onset does not take place, because the invention advantageously provides that the relief over a predetermined portion of the pump piston stroke takes place after a portion of this supply stroke has been executed. Here again, the termination of relief is advantageously effected by means of a load-dependent control of the outlet of the second relief conduit at a higher load or at full load. Thus after a pre-injection stroke, a genuine interruption of normal fuel injection at low load is effected. The result is a prolongation of the duration of injection, which particularly during idling results in quiet engine operation. This apparatus can advantageously be realized for controlling fuel quantity both by controlling the injection onset and by controlling the end of injection.

The dependent claims recite characteristics of advantageous embodiments of the invention in terms of effecting the communication between the first and second relief conduits over the predetermined portion of the stroke.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
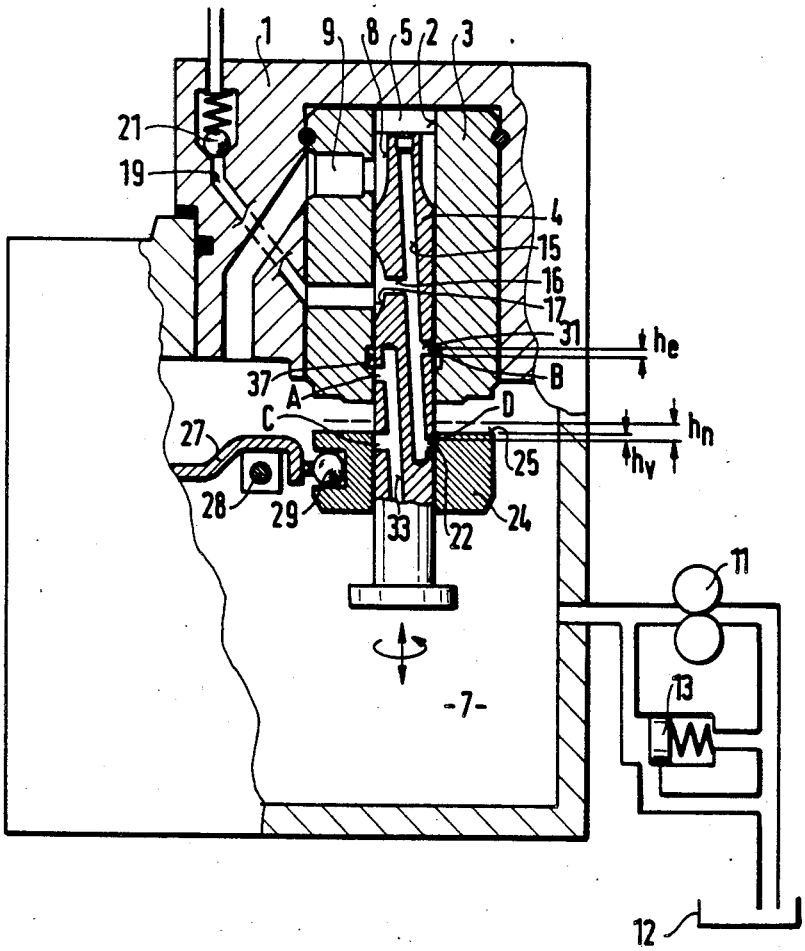
FIG. 1 shows in cross section a first exemplary embodiment of the invention having control of the end of the effective injection and control of the communication between the two relief lines via an annular groove.

A pump piston 4 is disposed in a cylinder 2 of a cylinder liner 3 inserted into a pump housing 1 of a fuel injection pump. By means not shown, the pump piston 4 is set into simultaneous reciprocation and rotation. On one end, the pump piston 4 encloses a pump work chamber 5, and the pump piston protrudes partway out of the cylinder 2 into a pump suction chamber 7. The drive of the pump piston 4 is effected at this end as well.

The pump work chamber 5 is supplied with fuel via longitudinal grooves 8 disposed in the jacket face of the pump piston 4 and via an intake bore 9 extending through the cylinder liner 3 in the housing 1, as long as the pump piston is executing its intake stroke or is at its bottom dead center position. The intake bore 9 discharges at its other end in the pump suction chamber 7. The pump suction chamber 7 is supplied with fuel from a fuel container 12 via a feed pump 11. The pressure in the suction chamber 7 is controlled in a known manner by a pressure control valve 13.

Leading away from the work chamber 5 is a longitudinal conduit 15 in the pump piston, which is embodied as a blind bore and will be called the first relief line. Branching off from it is a radial bore 16, which leads to a distributor opening 17 in the jacket face of the pump piston 4. Branching off in a radial plane of the cylinder 2, within the working range of this distributor opening 17, are supply lines 19, which are distributed about the circumference of the cylinder and correspond in number to the number of cylinders of the associated internal combustion engine that are to be supplied with fuel. The supply lines 19 each lead via a respective one-way valve 21, which in a known manner is embodied as a check valve or pressure relief valve, to the fuel injection locations, not shown.

A radial bore 22 branches off at the end of the first relief line 15 and discharges at an outlet cross section D in the jacket face of the pump piston, in fact in the vicinity of the portion of the pump piston that protrudes into the pump suction chamber. In this vicinity, a quantity adjusting device in the form of an annular slide 24 is disposed on the pump piston, being tightly displaceable thereon and with its upper end forming a control edge 25, by means of which the outlet cross section D is controlled. The axial position of the annular slide 24 is determined in a known manner by a governor lever 27, which is pivotable about a shaft 28 attached to the housing and is coupled via a ball head 29 at the end of one of its lever arms with the annular slide 24. In a known manner, the annular slide is adjusted by means of a governor, not otherwise shown here, in accordance with load and/or rpm. At a desired large fuel injection quantity, the annular slide 24 assumes an upper position near the pump work chamber, and with decreasing load it is displaced increasingly downward from this position. Thus the available useful stroke $h_n$ at a given time varies; the useful stroke is that which the pump piston or the outlet cross section D must traverse from the bottom dead center of the pump piston in order to be opened by the control edge 25 of the annular slide 24.

A third radial bore 31 which discharges at a second outlet B on the jacket face of the pump piston 4 branches off from the first relief line 15. A second relief line 33 is also provided in the pump piston 4, having an inlet A in the vicinity of the portion of the pump piston jacket face that is always located in the cylinder 2 and an outlet C in the working range of the annular slide 24. The outlet C is offset toward the pump work chamber 5 by the constant amount $h_v$ with respect to the first outlet D of the first relief conduit 15, so that in the course of the pump piston stroke, the outlet C is always opened first by the control edge 25, before the first outlet C is opened.

Within the stroke range of the inlet A of the second relief line 33 and the second outlet B of the first relief line 15, an annular groove 37 is disposed in the wall of the cylinder 2. The inlet A and the second outlet B are associated with one another such that whenever the inlet A has just come to overlap the lowermost edge of the annular groove 37, during the course of the pumping stroke of the pump piston, the second outlet B of the first relief line 15 is already in a state of overlap with the annular groove 37, and after an intended pump piston stroke $h_e$ ceases to overlap the annular groove 37, a point at which the inlet A of the second relief line 33 is still in a state of overlap with the annular groove 37. In this manner, for the predetermined stroke portion having the length $h_e$, communication is established between the first relief line 15 and the second relief line 33.

Figure 2:
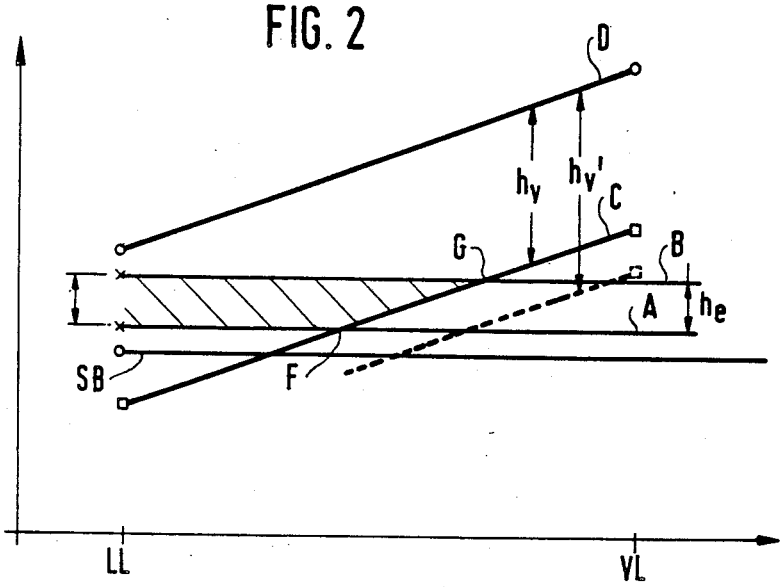
FIG. 2 is a control diagram relating to the exemplary embodiment of FIG. 1.

The relationship among the above-mentioned cross sections and control edges is illustrated in the diagram of FIG. 2, in which the relationship of the cross sections in the course of the pump piston stroke is plotted over the load, that is, over the position of the annular slide 24. The symbol LL stands for idling, and VL stands for full load. The horizontal line SB indicates the injection onset, which may for instance agree with the beginning of the pump piston stroke as it leaves its bottom dead center position. The pump work chamber 5, which had previously been filled via the intake bore 9 and the longitudinal grooves 8, is then joined with one of the supply lines via the first relief line 15, the radial bore 16, and the distributor groove 17, in accordance with the rotational position of the pump piston.

The line C represents the opening point of the outlet C of the second relief line 33. This line rises as the load increases, in accordance with the position of the annular slide 24, which is adjusted as a function of the load. Further, at D is indicated the opening point of the first outlet of the first relief line 15. This opening D extends substantially parallel to the line C and represents the possible useful stroke $h_n$. This useful stroke is shown in FIG. 1, on the condition that in the position shown, the pump piston is at bottom dead center. For the instance illustrated, the position of the annular slide 24 was assumed to be as indicated by the dashed line.

Parallel to the line SB, there is a line A, which indicates the opening point of the inlet A of the second relief line 33. The line B that is parallel to it indicates the piston stroke at which the second outlet of the first relief line is closed. In the stroke range between A and B, that is, the stroke $h_e$, there is communication between the first relief line 15 and the second relief line 33. Only within this stroke range can the fuel pumped by the pump piston in this range, or a portion of this fuel, drain out via the second relief line 33. However, on a second condition, this is possible only if the outlet C of the second relief line is opened; in other words, beyond the point of intersection of the line C and the line B, no further drainage of fuel is possible. This point G is located prior to the full-load point, so that in the upper load range and at full load, the entire working capacity of the pump piston can be exploited for pumping fuel. At zero load, in the idling range or at low partial load, the relief range between the lines A and B is located within the range between C and D, so that over this range, a constant fuel quantity is initially drained off per pumping stroke of the pump piston, as long as the line C intersects the line A at point F. Between F and G, the relief quantity becomes increasingly smaller. The location of the range $h_e$ and its useful level can be optimized with a view to quiet combustion at low load and without affecting injection timing, which [timing] for instance can be effected by a separate injection onset adjuster of known design.

Figure 3:
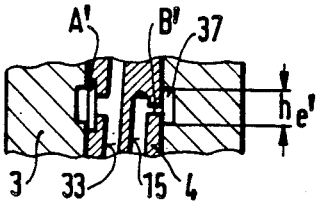
FIG. 3 shows a fragmentary second exemplary embodiment, which is a modification of that shown in FIG. 1, having an annular groove at a definite level of the stroke and a slit-like inlet cross section, extending in the circumferential direction, of the second relief line.

FIG. 3 shows a different type of communication between the first relief line 15 and the second relief line 33 in a portion of the piston. Here the annular groove 37 has a definite height $h_e'$ and the inlet A' of the second relief line 33 is widened in the stroke direction so that it remains continuously in communication with the annular groove 37, and the second outlet B' of the first relief line 15 is in the form of a slit. During the supply stroke of the pump piston 4, the second relief line 33 thus remains in constant communication with the annular groove 37. The duration of communication between the first relief line 15 and the second relief line 33 is now determined by the slit-like second outlet B' during the period of overlap $h_e$ with the annular groove 37.

This embodiment has the advantage that the control times of the overlap can be more accurately defined. By means of the slit-like embodiment of the second outlet B', a rapid opening is effected, thereby reducing the influence of rpm upon the drainage quantity. The slit-like embodiment has the further advantage that it enables defining a throttle cross section, which controls the amount of relief via the stroke $h_e$.

Figure 4:
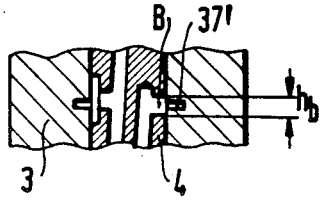
FIG. 4 shows a fragmentary third exemplary embodiment, having a slit-like annular groove and an inlet cross section of the second relief line having a definite stroke level.

FIG. 4 shows an equivalent embodiment to that of FIG. 3. Here, it is not the second outlet D but the annular groove 37′ that is slit-like in embodiment, and the width of the second outlet B having the length $h_b$ determines the duration of the overlap $h_e$.

Figure 5:
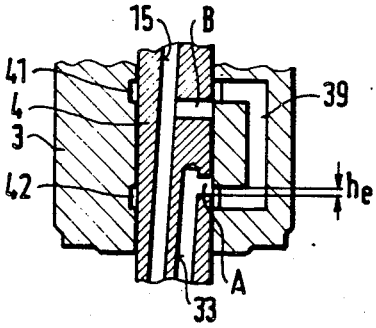
FIG. 5 shows a fragmentary fourth exemplary embodiment, having a substantially axially extending bypass conduit in the wall of the cylinder for controlling the communication of the first relief line with the second relief line.

A fourth exemplary embodiment of the communication between the first relief line 15 and the second relief line 33 is shown in FIG. 5. There, a bypass conduit 39 is provided in the cylinder liner 3, extending axially parallel to the axis of the pump piston. The bypass conduit 39 discharges into a first annular groove 41 near the pump work chamber and at its other end it discharges into a second annular groove 42 near the pump suction chamber. The location of the second outlet B of the first relief line 15 and of the inlet A of the second relief line 33 are associated such that once the second outlet B has come to overlap the annular groove 41, the inlet A remains in a state of overlap with the second annular groove 42 only over a first stroke $h_e$. The relationship may naturally be reversed. What is important is only that the overlap range $h_e$ is adhered to. It is also possible for the annular grooves 41 and 42 to be provided on the pump piston in an equivalent manner.

Figure 6:
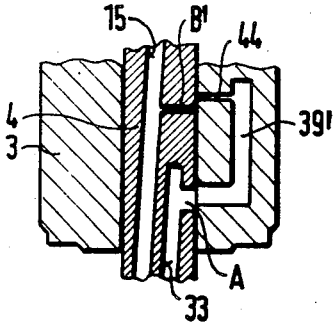
FIG. 6 shows a fragmentary fifth exemplary embodiment, which is a modification of that shown in FIG. 5 and in which the duration of the overlap is effected by controlling the slit.

Instead of this arrangement, the embodiment may also be as shown in FIG. 6, in which the second outlet B′ of the first relief line 15 is again slit-like in embodiment, and the mouth of the bypass conduit 39′ toward the pump work chamber is again arranged in the form of a slit 44 of equal width. The other end of the bypass conduit 39′ communicates with the second relief line 33 via the inlet A regardless of the pump piston stroke. In this embodiment, the width of the slit B′ or 44 determines the duration of the overlap $h_e$.

Figure 7:
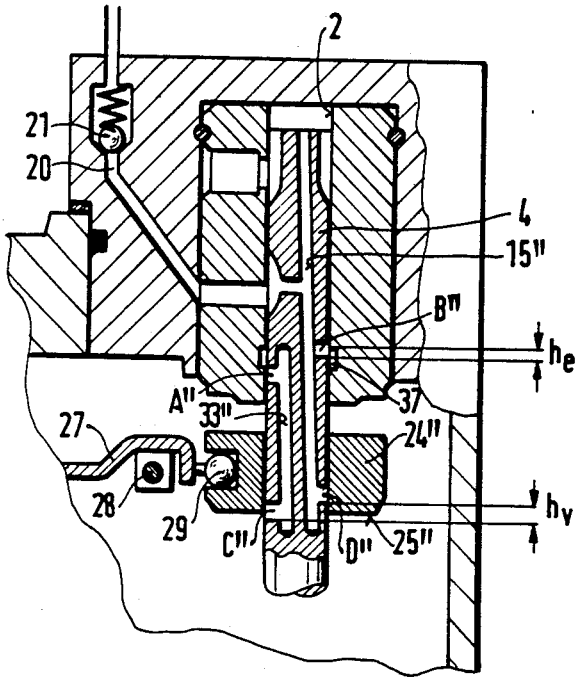
FIG. 7 shows an enlarged detail view of a sixth exemplary embodiment of the invention in a fuel injection pump designed for control of the injection onset in order to meter the fuel quantity.

Referring to the sixth exemplary embodiment shown in FIG. 7, it will be observed that the above-described apparatus for attaining quiet engine operation during idling and in the partial-load range can also be realized when the annular slide 24″ controls not the end of pump piston supply at an earlier or later point prior to top dead center, but rather the onset of pump piston supply following an idle pump piston stroke of variable length. The embodiment of the fuel injection pump with a pump piston 4′, cylinder 2 and annular slide 24″ is substantially identical to that of the exemplary embodiment of FIG. 1. The difference is that here the annular slide is actuated in an opposite manner by the governor lever 27. Differing from the exemplary embodiment of FIG. 1, the first outlet D″ is disposed such that at the beginning of the pump piston supply stroke it is initially closed by the control edge 25″, which is now located at the bottom, before the control edge 25″ opens the next outlet C″ of the second relief conduit 33″. The structural difference in the stroke is symbolized here as $h_v$: as in the exemplary embodiment of FIG. 1, the inlet A″ of the second relief line 33″ and the second outlet B″ of the first relief line 15 are disposed in the working range of the annular groove 37.

Figure 8:
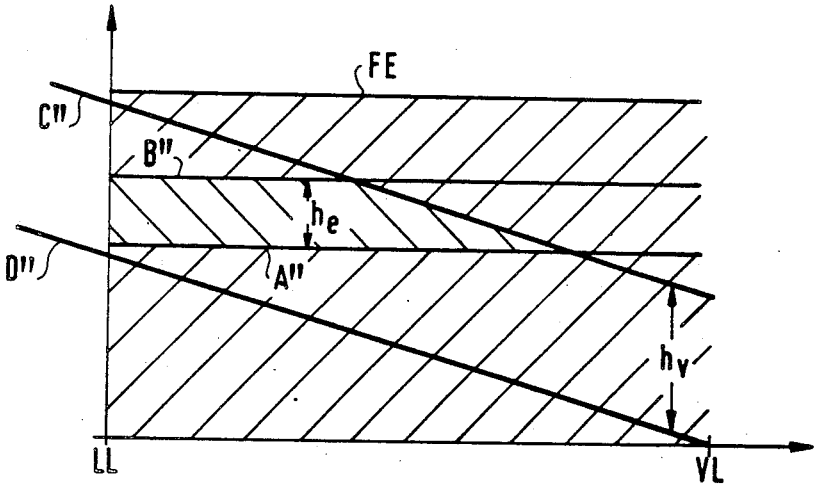
FIG. 8 is a control diagram relating to the exemplary embodiment of FIG. 7.

FIG. 8 is a diagram for the sixth exemplary embodiment, which generally corresponds to that view in FIG. 2. The line D″ slopes in the direction of full load, in accordance with the variable position of the annular slide 24″. The line C″, which indicates the closing point of the outlet C″, slopes in the same manner, being spaced apart by the distance $h_v$ from the line indicating the closing point of the first outlet cross section D″. FE is a line extending parallel with the abscissa, which indicates the constructive end of supply of the pump piston. Lines A″ and B″ are also shown in the diagram, being lines parallel to the line FE. A″ represents the point at which the inlet A″ comes into communication with the annular groove 37, at which point the communication between the second outlet B″ and the annular groove 37 still exists; and B″ represents the point at which the second outlet B″ is closed and the communication between the first relief line 15 and the second relief line 33 is broken. A reduction of the resultant injection rate during idling and at low load by the means of intermittently interrupted or reduced supply is attained in this embodiment of a fuel injection pump as well. The difference from the exemplary embodiment of FIG. 1 is that the pre-injection quantity prior to the relief is dependent on load.

In the exemplary embodiments, the pump supply strokes that are effective in control are controlled with control edges and control cross sections which are oriented in terms of radial planes with respect to the axis of the pump piston. However, since when the pump piston is driven it has a fixed relationship between its rotational position and its stroke position, the control can also be realized by means of axially oriented control edges, such as longitudinal grooves.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines comprising a pump cylinder, a reciprocating pump piston in said pump cylinder which encloses a pump work chamber arranged to communicate continuously with a first relief line, an intake bore for fuel supply to said pump cylinder, a second relief line in the pump piston, the pump piston having a jacket face provided with an inlet (A) and an outlet (C) of said second relief line, a control edge arranged to open and close an outlet (D) of said first relief line at a predetermined point of the pump piston stroke course and arranged to be adjusted in accordance with load and/or rpm to change said predetermined point, the adjustment of said control edge further adjusts the point of the pump piston stroke course at which the outlet of said second relief line is opened wherein beyond a first, fixed stroke of the pump piston, communication is interrupted between the inlet (A) of the second relief line and a connecting opening (B) of a relief line, which leads uninterrupted to said pump work chamber wherein opening of said outlet (C) of said second relief line is effected at a constant, fixed partial stroke ($h_v$) of the pump piston prior to said predetermined point of the pump piston stroke course, wherein the predetermined stroke portion ($h_e$) of said supply stroke is less than the fixed partial stroke ($h_v$) and further that the predetermined stroke portion is located such that in the upper load range the outlet (C) of the second relief line is in a closed position until after communication between the relief line leading to the pump work chamber and the second relief line has been interrupted, and said inlet (A) of the second relief line, is connected to the first relief line over a predetermined stroke portion ($h_e$) of the pump piston supply stroke after a portion of the high pressure supply stroke of the pump piston.

2. A fuel injection pump for internal combustion engines comprising a pump cylinder (2), a reciprocating pump piston (4) in said pump cylinder which encloses a pump work chamber (5) arranged to communicate continuously with a first relief line (15), an intake bore (9) for fuel supply to said pump cylinder, a second relief line (33) in the pump piston, the pump piston having a jacket face provided with an inlet (A) and an outlet (C) of said second relief line, a control edge arranged to open and close an outlet (D) of said first relief line at a predetermined point of the pump piston stroke course and arranged to be adjusted in accordance with load and/or rpm to change said predetermined point, the adjustment of said control edge further adjusts the point of the pump piston stroke course at which the outlet of said second relief line is opened wherein beyond a first, fixed stroke of the pump piston, communication is established between the inlet (A) of the second relief line and a connecting opening (B) of a relief line, which leads uninterrupted to said pump work chamber wherein the closure of said outlet (C) of said second relief line is effected at a constant fixed partial stroke ($h_v$) of the pump piston after said predetermined point of the pump piston stroke course and said inlet (A) of the second relief line, is connected to the first relief line over a predetermined stroke portion ($h_e$) of the pump piston supply stroke after a portion of the high pressure supply stroke of the pump piston, wherein the predetermined stroke portion ($h_e$) of said supply stroke is less than the fixed partial stroke ($h_v$) and further that the predetermined stroke portion is located such that in the upper load range the outlet (C'') of the second relief line is in a closed position before the communication between the first relief line leading to the pump work chamber and the second relief line is established.

3. A fuel injection pump as defined by claim 1, further wherein the first relief line and the second relief line are arranged in the pump piston and further that the first relief line serves as said relief line leading uninterrupted to said pump work chamber and has a first outlet (D) controllable by said control edge and further a second outlet (B) axially offset from the inlet (A) of the second relief line, in the working range of the cylinder and the communication between the two relief lines is effected via a conduit in the wall of the cylinder which surrounds the pump piston.

4. A fuel injection pump as defined by claim 2, further wherein the first relief line and the second relief line are arranged in the pump piston and further that the first relief line serves as said relief line leading uninterrupted to said pump work chamber and has a first outlet (D) controllable by said control edge and further a second outlet (B), axially offset from the inlet (A) of the second relief line, in the working range of the cylinder and the communication between the two relief lines is effected via a conduit in the wall of the cylinder which surrounds the pump piston.

5. A fuel injection pump as defined by claim 3, further wherein the conduit is an annular groove.

6. A fuel injection pump as defined by claim 3, further wherein the second outlet (B) of the first relief line or the inlet (A) of the second relief line is in communication with the conduit, regardless of the piston stroke and the width in the axial direction of the inlet (A) of the second relief line or of the second outlet (B) of the first relief line and/or of the annular groove, as the element which determines the predetermined stroke portion ($h_e$), is reduced as compared with the width of the other elements recited.

7. A fuel injection pump as defined by claim 3, further wherein the conduit is embodied as a bypass conduit having end portions including outlets and wherein said conduit extends in an axial direction of said pump piston.

8. A fuel injection pump as defined by claim 7, further wherein the openings of the second outlet (B) of the first relief line or the inlet (A) of the second relief line are arranged to communicate, regardless of the pump piston stroke, with one of the end portions of the bypass conduit and contrarily the width in the axial direction at the openings of the inlet (A) of the second relief line or of the second outlet (B) of the first relief line and/or the width in the axial direction of the outlet of the end portions of the bypass conduit as the elements which control the predetermined stroke portion ($h_e$), are reduced as compared with the width of the other openings.

9. A fuel injection pump as defined by claim 1, further wherein the outlet (C) of the second relief line and the first outlet (D) of the first relief line discharge into an end of the pump piston which protrudes out of the cylinder and on which there is displaceable a valve member provided with said control edge for the control of said outlets (C) and (D).

10. A fuel injection pump as defined by claim 2, further wherein the outlet (C) of the second relief line and the first outlet (D) of the first relief line discharge into an end of the pump piston which protrudes out of the cylinder and on which there is displaceable a valve member provided with said control edge for the control of said outlets (C) and (D).

11. A fuel injection pump as defined by claim 3, further wherein the outlet (C) of the second relief line and the first outlet (D) of the first relief line discharge into an end of the pump piston which protrudes out of the cylinder and on which there is displaceable a valve member provided with said control edge for the control of said outlets (C) and (D).

12. A fuel injection pump as defined by claim 1, further wherein a throttle cross section B' is provided with an opened connection between the first relief line and the second relief line.

13. A fuel injection pump as defined by claim 2, further wherein a throttle cross section B' is provided with an opened connection between the first relief line and the second relief line.

14. A fuel injection pump as defined by claim 3, further wherein a throttle cross section B' is provided with an opened connection between the first relief line and the second relief line.

15. A fuel injection pump as defined by claim 4, further wherein a throttle cross section B' is provided with an opened connection between the first relief line and the second relief line.

* * * * *